US005375348A

United States Patent [19]

Kishi

[11] Patent Number: 5,375,348

[45] Date of Patent: Dec. 27, 1994

[54] DEEP EXCAVATOR

[75] Inventor: Mitsuhiro Kishi, Ashikaga, Japan

[73] Assignee: Japanic Corporation, Tochigi, Japan

[21] Appl. No.: 30,844

[22] Filed: Mar. 12, 1993

[30] Foreign Application Priority Data

Apr. 23, 1992 [JP] Japan ..... 4-130104
May 26, 1992 [JP] Japan ..... 4-157331

[51] Int. Cl.[5] ..... B66C 3/02

[52] U.S. Cl. ..... 37/186; 37/461; 414/722; 414/729

[58] Field of Search ..... 37/461, 184, 185, 186, 37/187, 188, 466, 443, 406, 403, 379, 334, 335; 414/718, 719, 722, 726, 727, 729

[56] References Cited

U.S. PATENT DOCUMENTS

| | | | |
|---|---|---|---|
| 2,828,038 | 3/1958 | Dorkins | 37/461 X |
| 3,589,766 | 6/1971 | Bormioli | 37/461 X |
| 3,641,689 | 2/1972 | Billings | 37/186 |
| 3,814,471 | 6/1974 | Coeurderoy | 37/461 X |
| 3,881,263 | 5/1975 | Coeurderoy | 37/188 X |
| 4,005,895 | 2/1977 | Cullings | 37/461 X |
| 4,059,886 | 11/1977 | Bricon | 37/461 X |
| 4,733,598 | 3/1988 | Innes et al. | 91/168 |

*Primary Examiner*—Randolph A. Reese
*Assistant Examiner*—J. Russell McBee
*Attorney, Agent, or Firm*—Flynn, Thiel, Boutell & Tanis

[57] ABSTRACT

A stretchable arm of a deep excavator comprises top, middle and base arms wherein a bucket is suspended from the top arm and a working unit is fixed to the middle arm. Two hydraulic cylinders constituting the working unit are arranged in parallel with each other while cylinder rods thereof are oppositely directed, wherein the cylinder rod of one hydraulic cylinder is coupled to the base arm and the cylinder rod of the other hydraulic cylinder is coupled to the top arm. It is possible to extend and contract each arm of the stretchable arm synchronously with one another at higher speed compared with a conventional deep excavator having a single hydraulic cylinder. The oil under pressure which flows out from the discharge chamber of each hydraulic cylinder can be merged into the oil under pressure for extending each hydraulic cylinder so that the amount of oil to be supplied to the pressure chamber is increased.

16 Claims, 13 Drawing Sheets

DEEP EXCAVATOR

FIELD OF THE INVENTION

The present invention relates to an excavator for deeply excavating the earth in a construction site, building site, etc. to form a hole having a great depth, and particularly to an excavator having an extending mechanism which includes a plurality of telescopically assembled arms (hereinafter referred to as a stretchable arm).

BACKGROUND OF THE INVENTION

There have been many cases at a construction or building site where the earth must be deeply excavated to form a hole having a depth which is too long relative to its diameter. For example, there have been cases for excavating the earth to form a hole in which an anchor supporting a steel tower is embedded, a hole in which a water purifier tank is embedded, a hole for ground-making and a hole for well sinking. In such cases, the hole should generally have a depth which is too long, e.g. ranging from 15 m to 20 m, relative to its diameter, e.g. about 5 m.

In deep excavating work, there is conventionally employed a deep excavator having a telescopic mechanism comprising a stretchable arm fixed to a boom wherein a clamshell bucket (hereinafter referred to as a bucket) is coupled to the tip end of a top arm of the stretchable arm. In this arrangement of the deep excavator, most of the excavating mechanism comprises the stretchable arm which is fixed to the tip end of the boom has at least two stages of arms in which the bucket suspended from the top arm is hung to reach the bottom of the hole. However, in such an arrangement, arms of the stretchable arm must be extended and contracted synchronously with one another. This leads to a complex mechanism for extending and contracting each arm.

In the conventional mechanism for extending and contracting each arm, a wire or chain is entrained around or extended between each arm whereby each arm is extended and contracted synchronously with one another by such wire or chain. In such a mechanism, it is possible to smoothly extend or contract each arm of the stretchable arm but the wire or chain must be entrained around or extended between each arm, which makes the arrangement of the wire or chain complex. Furthermore, since the wire or chain for contraction of each arm as well as extension of each arm must be entrained around or extend between each arm, at least two wires or chains are required for one arm, which leads to a complex arrangement of the wires or chains. In such an arrangement of wires or chains, the wires or chains are liable to be exposed outside the stretchable arm which is not preferable in view of the external appearance. There is a likelihood that earth and sand is stuck to the wires or the chains, which causes abrasion or is troublesome to the mechanism.

Accordingly, there is proposed a mechanism for extending and contracting a stretchable arm using hydraulic power generated by hydraulic cylinders which are incorporated into the stretchable arm. However, in the conventional excavator, it is necessary to provide high pressure application hoses (hereinafter referred to as pressure hoses) on each hydraulic cylinder coupled to each arm for supplying oil under pressure to each hydraulic cylinder. If the pressure hoses are loosened, they become intricate in the stretchable arm, which makes the mechanism complex. Furthermore, the pressure hoses may become fatigued and broken if they are used for a long time. Still furthermore, if each arm is operated by a plurality of hydraulic cylinders, the stretchable arm cannot be extended or contracted at high speed and the extending and contracting speeds are slower compared with using wires or chains.

In the conventional excavator, if the wire or chain is used for extending and contracting the stretchable arm, the extending and contracting speeds are fast but the mechanism thereof is complex and there is the drawback in that the wire or chain is exposed outside the stretchable arm. Whereas, if the hydraulic cylinder is used for extending and contracting the stretchable arm, there is an advantage in that the external appearance of the stretchable arm is simple and the wire or chain is not exposed outside the stretchable arm but there is the drawback that the extending and contracting speeds are slow.

SUMMARY OF THE INVENTION

In view of the drawbacks of the conventional deep excavator, it is an object of a first aspect of the present invention to provide a deep excavator comprising a chassis, a turntable disposed on the chassis, a boom which is pivotally supported on the turntable and is vertically swingable, a stretchable arm which is stretchable in the longitudinal direction and comprises a plurality of telescopically assembled base, middle and top arms, and a bucket which is attached to the top arm for excavating and holding earth and sand, the deep excavator further comprising a working unit which is fixed to the middle arm and is operable by hydraulic pressure, the working unit comprising a pair of hydraulic cylinders which are arranged in parallel with each other in the manner that cylinder rods thereof are directed in opposite directions, wherein the cylinder rod of one hydraulic cylinder is connected to the top arm and the cylinder rod of the other hydraulic cylinder is connected to the base arm.

It is an object of a second aspect of the present invention to provide a deep excavator comprising a chassis, a turntable disposed on the chassis, a boom which is pivotally supported on the turntable and is vertically swingable, a stretchable arm which is stretchable in the longitudinal direction and comprises a plurality of telescopically assembled base, middle and top arms, and a bucket which is attached to the top arm for excavating and holding earth and sand, the deep excavator further comprising a working unit which is fixed to the middle arm and is operable by hydraulic pressure, the working unit comprising a pair of hydraulic cylinders which are arranged in parallel with each other in the manner that cylinder rods thereof are directed in opposite directions, wherein the cylinder rod of one hydraulic cylinder is connected to the top arm and the cylinder rod of the other hydraulic cylinder is connected to the base arm and wherein the hydraulic cylinders have discharge chambers therein respectively at the sides of cylinder rods thereof and pressure chambers at the sides opposite to the cylinder rods, wherein the pressure chambers of the hydraulic cylinders are connected to each other and the discharge chambers of the hydraulic cylinders are connected to each other, and the deep excavator further comprising a merging means for allowing the oil to flow under pressure in one direction between the pressure chambers and discharge chambers of the hydraulic cylinders.

DETAILED DESCRIPTION

First Embodiment (FIGS. 1 to 7)

Figure 1:
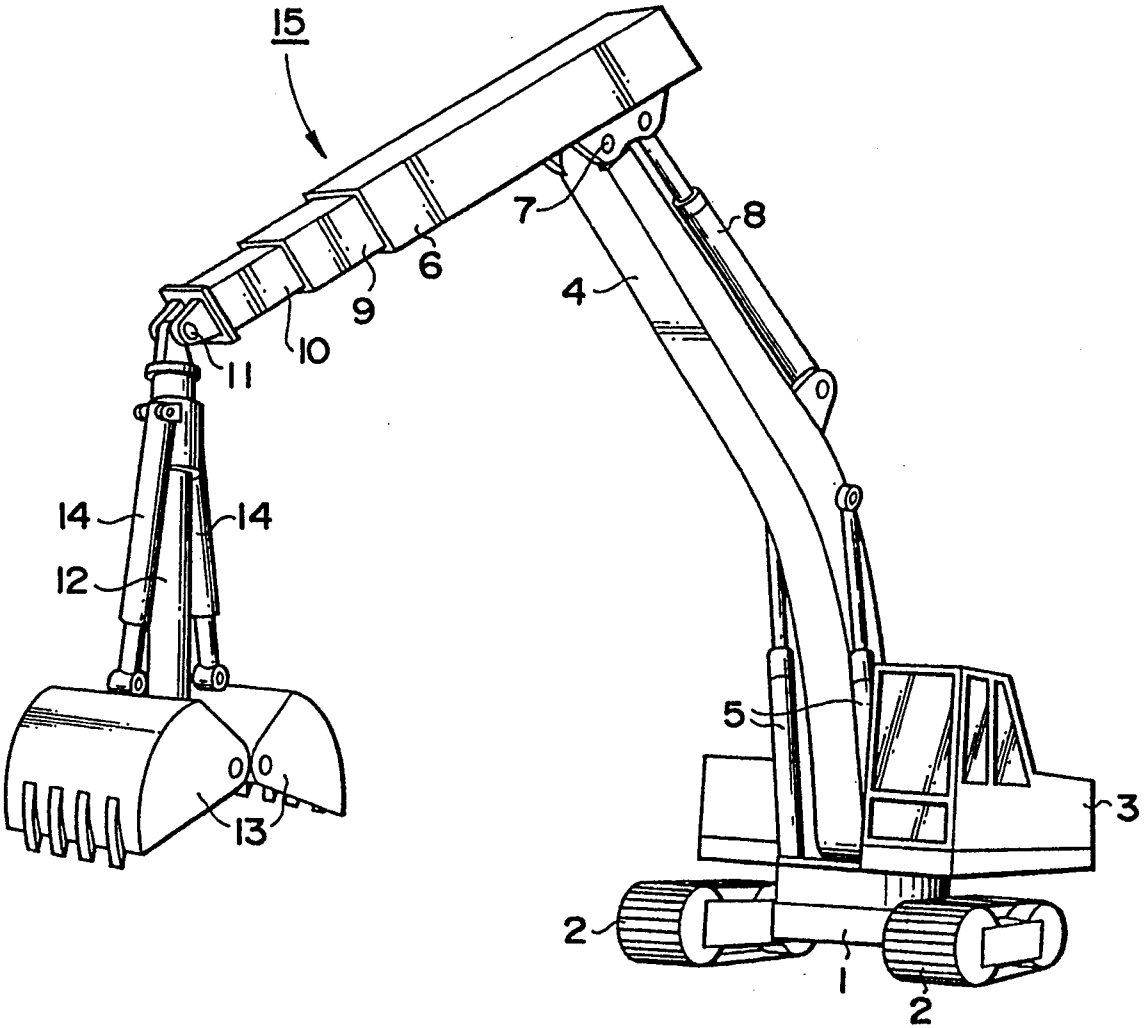
FIG. 1 is a perspective view of a deep excavator according to a first embodiment of the present invention.
Figure 2:
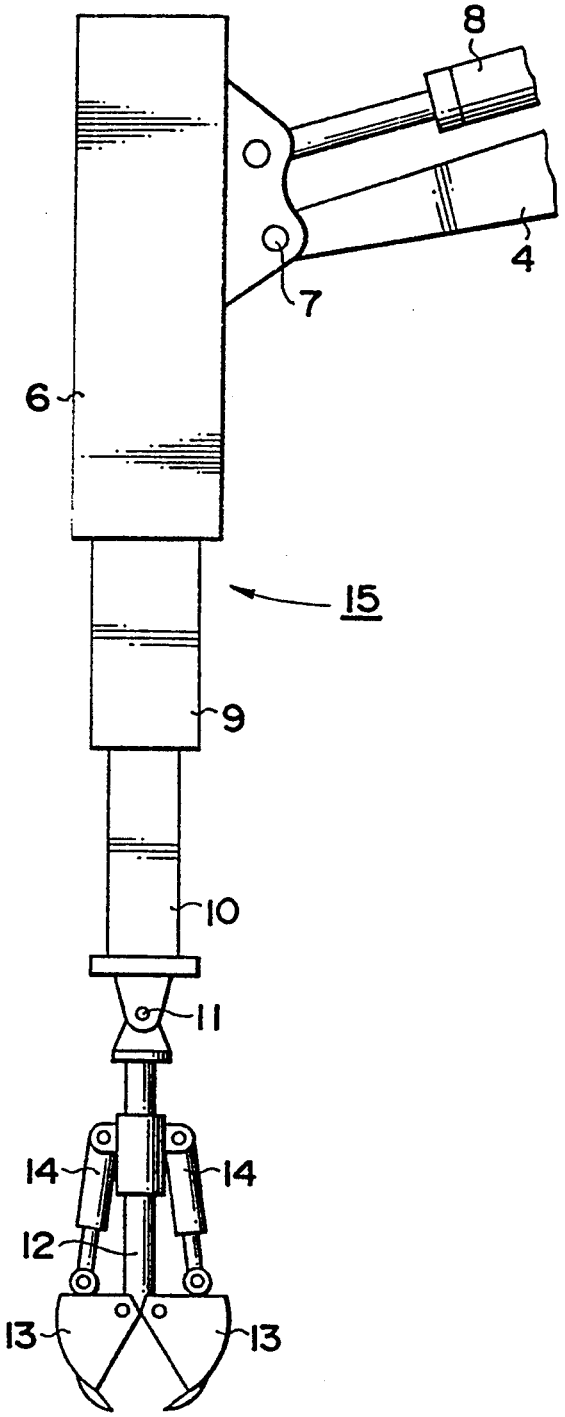
FIG. 2 is a side view of the entire external appearance of a stretchable arm according to the first embodiment.

A deep excavator according to a first embodiment will be described with reference to FIGS. 1 to 7.

Crawlers or tracks 2 are provided at both sides of a chassis 1 of an excavator which is freely movable, i.e. right and left, forward and rearward by these crawlers 2. A turntable 3 is disposed over the upper surface of the chassis 1 so as to be turned 360° horizontally. A substantially L-shaped boom 4 is pivotally mounted adjacent its lower end on an upper front surface of the turntable 3 so as to be swingable vertically. A first hydraulic cylinder 5 is interposed between the center of the boom 4 and the front surface of the turntable 3 for vertically turning the boom 4 relative to the turntable 3 at some angles. A long hollow base arm 6 having a square shape in cross section is coupled to the tip end of the boom 4 by a hinge pin 7 so as to be swingable vertically, and a second hydraulic cylinder 8 is interposed between the center of the rear surface of the boom 4 and the rear end of the base arm 6 to control swinging of arm 6. The base arm 6 is formed by bending a thin steel plate and has a square shape in cross section. The base arm 6 has a lower end opening through which a long hollow middle arm 9, which is formed by bending a thin steel plate and has a square shape in cross section, is slidably inserted. The middle arm 9 has a lower end opening through which a long hollow top arm 10, which is formed by bending a thin steel plate and has a square shape in cross section, is slidably inserted. These base arm 6, the middle arm 9 and the top arm 10 constitute a telescopic stretchable arm 15. A cylindrical hanging shaft 12 is coupled to the tip end of the top arm 10 by a hinge pin 11 so as to be always directed downward. A bucket 13, comprising a pair of bucket halves which are closable to excavate the earth and hold the excavated earth and sand, is hingedly coupled to the lower end of the hanging shaft 12.

Third and fourth hydraulic cylinders 14 are interposed between the center of the hanging shaft 12 and rear surfaces of each bucket halves 13.

Figure 3:
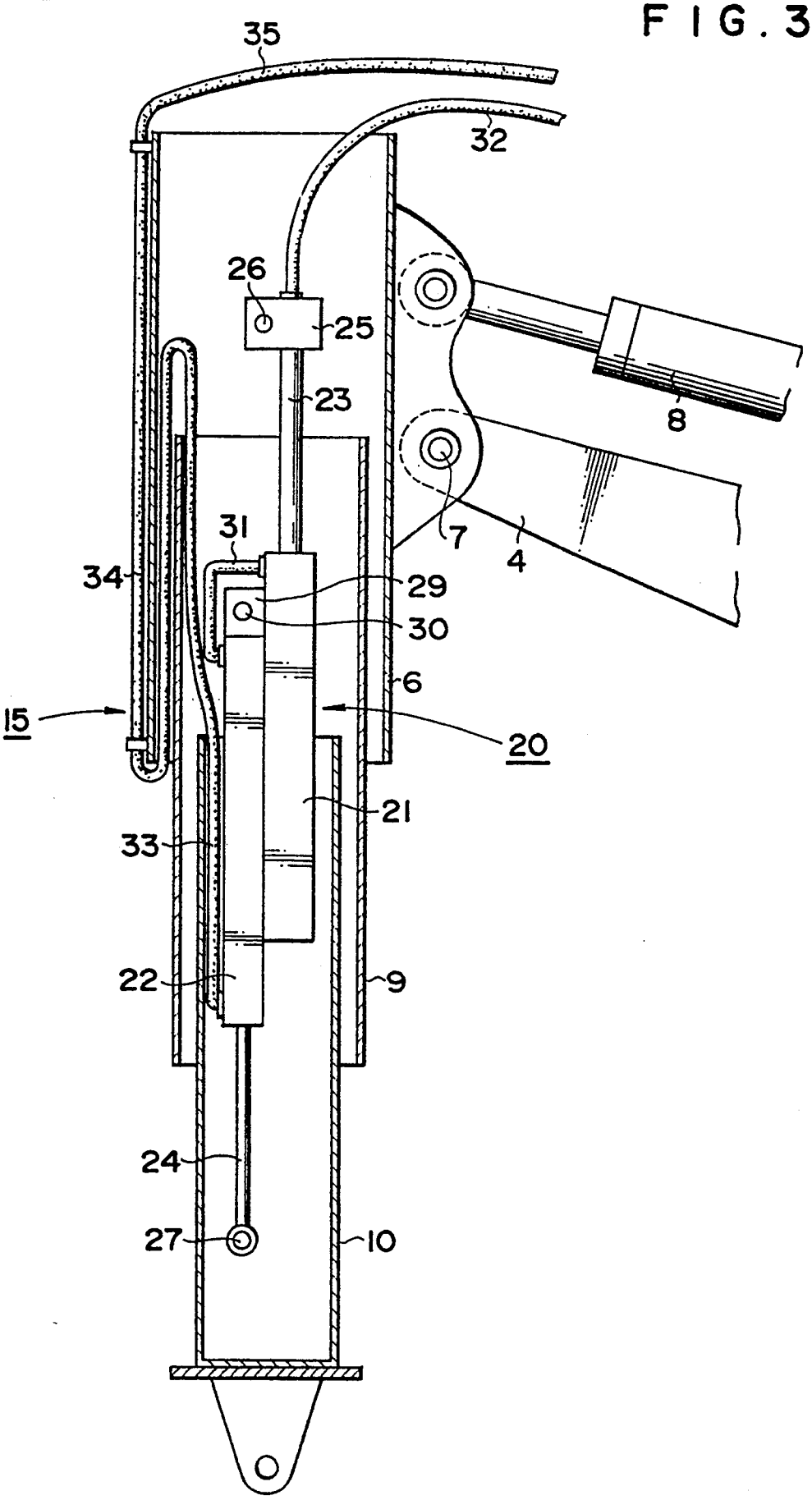
FIG. 3 is a side cross-sectional view of the internal arrangement of the stretchable arm according to the first embodiment.

As shown in FIG. 3, which is a cross-sectional view of the internal arrangement of the stretchable arm 15, the top arm 10 is inserted into the middle arm 9 and the middle arm 9 is inserted into the base arm 6, and these arms are assembled whereby the top and middle arms 10 and 9 respectively slide in the middle and base arms 9 and 6 in the longitudinal directions thereof. A working unit 20 comprises large and small sized hydraulic cylinders which are arranged in parallel with each other in the longitudinal direction thereof. The large sized hydraulic cylinder (hereinafter referred to as the large cylinder) 21 and the small sized hydraulic cylinder (hereinafter referred to as the small cylinder) 22 are arranged in parallel with each other in the axial directions thereof and are fixed to the middle arm 9 so as to be integrated with each other while their working directions are opposite to each other. A large rod 23 of the large cylinder 21 is directed upwardly and a small rod 24 of the small cylinder 22 is directed downwardly. A block 29 is fixed to the rear end of the small cylinder 22 and it is coupled to the middle arm 9 by a pin 30. Accordingly, the working unit 20 moves together with the middle arm 9. The large rod 23 extends upward from the upper end of the large cylinder 21 and is slidably inserted into the large cylinder 21. A block-shaped rod head 25 is fixed to rod and connects to the upper portion of the base arm 6 by a pin 26. The small rod 24 extends downward from the lower end of the small cylinder 22 and is slidably inserted into the small cylinder 24. The lower end of the small rod 24 is coupled to the lower portion of the top arm 10 by a pin 27.

The upper end of the large rod 23 (which is hollow) is connected to a flexible pressure hose 32 which is connected to a motor accommodated in the turntable 3 and is formed of rubber or resin and through which oil under pressure flows. A synchronous flow pipe 31 is connected between a discharge chamber, described below, of the large cylinder 21 and a pressure chamber, described below, of the small cylinder 22. A discharge chamber, described below, of the small cylinder 22 is connected to one end of a flexible return hose 33 which is formed of rubber or resin and through which the oil under pressure flows. The other end of the return hose 33 is connected to one end of a pressure pipe 34 which passes through a gap between the base arm 6 and the middle arm 9 and is fixed to the side surface of the base arm 6. The other end of the pressure pipe 34 is connected to a pressure discharge hose 35 which is formed of rubber or resin and communicates with an oil pressure source accommodated inside the turntable 3 and through which oil under pressure flows.

Figure 4:
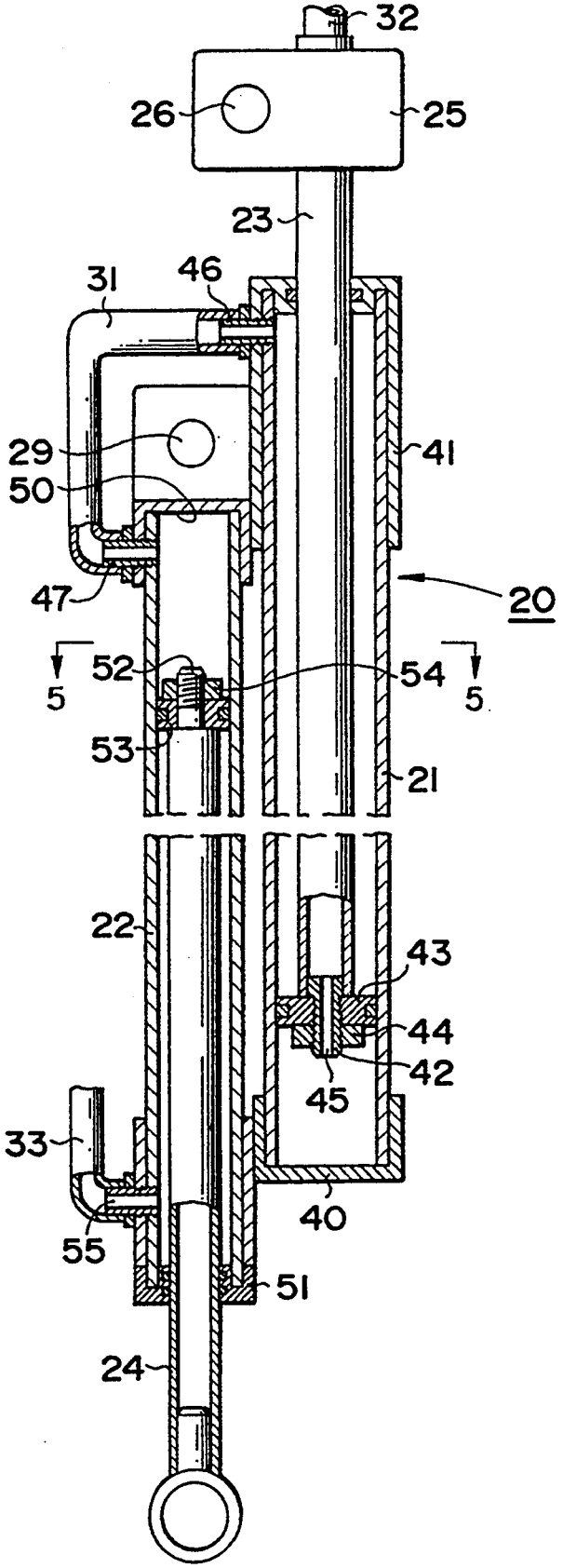
FIG. 4 is a cross-sectional view of the arrangement of a working unit according to the first embodiment.

FIG. 4 illustrates the internal arrangement of the working unit 20. The large cylinder 21 is shaped as a round pipe, the inside of which is hollow and the upper and lower ends of which are open. A closing cap 40 engages airtightly with the lower end opening of the large cylinder 21 for closing the lower end opening. A cap 41, which has a sliding hole at the center thereof, engages with the upper end opening of the large cylinder 21. The large rod 23 is airtightly slidable inserted into the sliding hole of the cap 41. The large rod 23 per se is hollow inside and has the shape of a round pipe. A fixed bolt 42 having a screw at the outer periphery thereof is fixed to the tip end of the lower end of the large rod 23. The fixed bolt 42 is inserted into a piston 43 which slidably contacts airtightly the inner surface of the large cylinder 21. The piston 43 is connected to the large rod 23 by a nut 44 which screws onto the fixed bolt 42. The fixed bolt 42 is penetrated at its central axis for forming an oil introduction hole 45 through which the inner space of the large rod 23 communicates with the pressure chamber located at the lower portion of the large cylinder 21. The inside of the large cylinder 21 is separated into the upper half and lower airtight chambers by slidably inserting the piston 43 into the large cylinder 21, wherein the former is called the discharge chamber and the latter is called the pressure chamber.

Likewise, the small cylinder 22 has the shape of a round pipe, the inside of which is hollow and the upper and lower ends of which are open. A closing cap 50 engages airtightly with the upper end opening of the small cylinder 22 for closing the upper end opening. A cap 51, which has a sliding hole at the center thereof, engages with the lower end opening of the small cylinder 22. The small rod 24 is airtightly slidably inserted into the sliding hole of the cap 51. A fixed bolt 52 having a screw at the outer periphery thereof is fixed to the tip end of the upper end of the small rod 24. The fixed bolt 52 is inserted into a piston 53 which slidably contacts airtightly the inner surface of the small cylinder 22. The piston 53 is connected to the small rod 24 by a nut 54 which screws onto the fixed bolt 52. The inside of the small cylinder 22 is separated into upper half and lower airtight chambers by slidably inserting the piston 53 into the small cylinder 22, wherein the former is called the pressure chamber and the latter is called the discharge chamber.

A port 46 is provided at the upper side surface of the large cylinder 21 for communicating with the discharge chamber of the large cylinder 21. A port 47 is provided at the upper side surface of the small cylinder 22 for communicating with the pressure chamber of the small cylinder 22. Both the ports 46 and 47 are connected to each other by the synchronous flow pipe 31. A port 55 is provided at the lower side surface of the small cylinder 22 for communicating with the discharge chamber of the small cylinder 22. The port 55 is connected to the tip end of the return hose 33.

Figure 5:
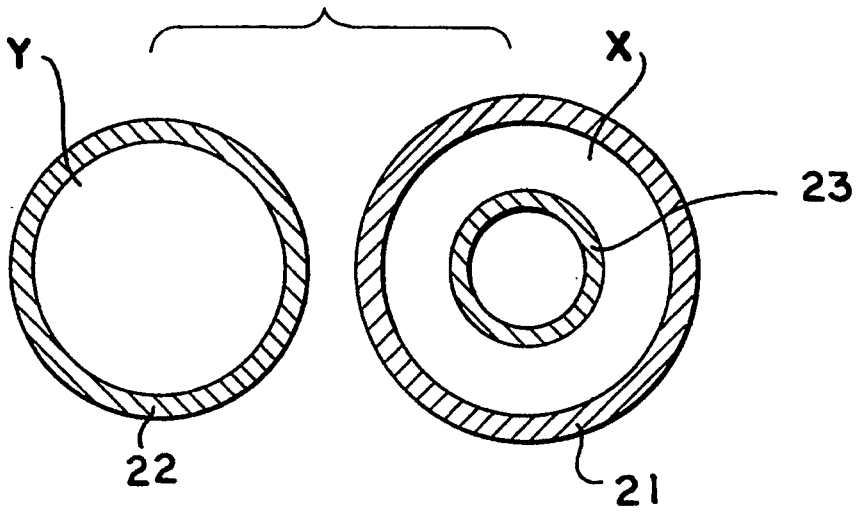
FIG. 5 is a view explaining the cross-sectional area as taken along line 5—5 in FIG. 4.

FIG. 5 shows cross-sections of the large and small cylinder 21 and 22 taken along the line 5—5 of FIG. 4. In FIG. 5, the cross-sectional area of the discharge chamber of the large cylinder 21 equals an area denoted X which is obtained by subtracting the area surrounded by the outer periphery of the large rod 23 from the area surrounded by the inner periphery of the large cylinder 21, and the cross-sectional area of the small cylinder 22 equals an area denoted Y which corresponds to the area surrounded by the inner periphery of the small cylinder 22. The shapes of the large and small cylinders 21 and 22 are determined in a manner such that the cross-sectional area X equals to the cross-sectional area Y. Oil under pressure is applied to the cross-sectional areas X and Y (hereinafter referred to as pressure application cross-sectional areas X and Y).

Figure 6:
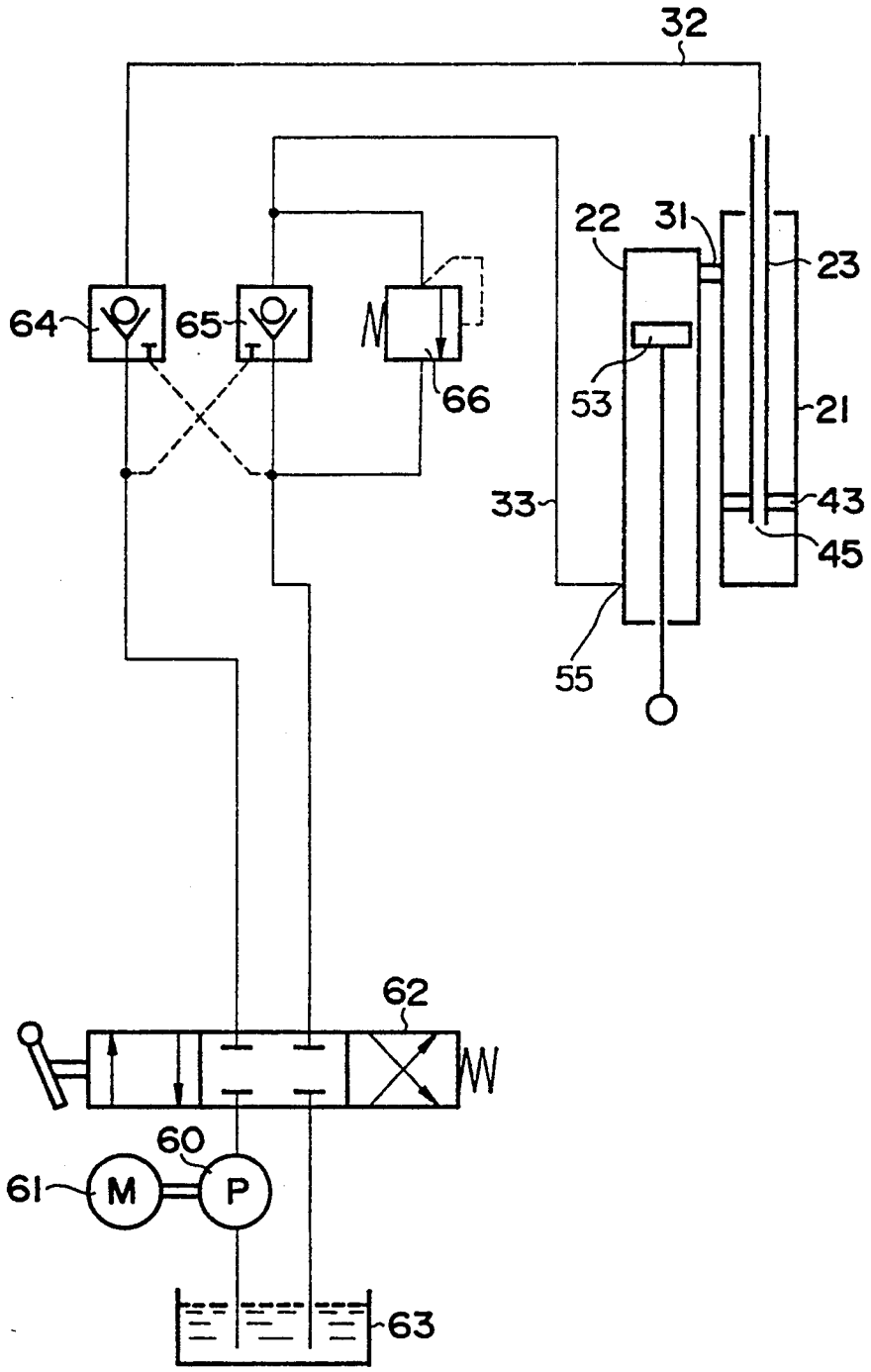
FIG. 6 is a diagrammatic view of a hydraulic system according to the first embodiment.

FIG. 6 shows a hydraulic circuit according to the first embodiment of the present invention. In FIG. 6, a pressure oil pump 60 is driven by a motor 61 and has a suction side which communicates with an oil tank 63 and a discharge side which is connected to a directional control valve 62. One end of the directional control valve 62 is connected to one end of the pressure hose 32 by way of a first pilot check valve 64. The other end of the pressure hose 32 communicates with the upper opening of the large rod 23. The return hose 33 connected to the port 55 communicates with the other end of the directional control valve 62 by way of a second pilot check valve 65. The other end of the directional control valve 62 is also connected to the oil tank 63 so that the oil under pressure returns to the oil tank 63. A relief valve 66 is normally closed and is disposed in parallel with the second pilot check valve 65 and connected to the pressure hose 33 and the directional control valve 62. The first and second pilot check valves 64 and 65 are connected in a parallel with each other so that they are operated by reception of oil pressures which are applied from the other check valves 65 and 64, respectively.

The operation of the deep excavator will now be described.

Figure 7:
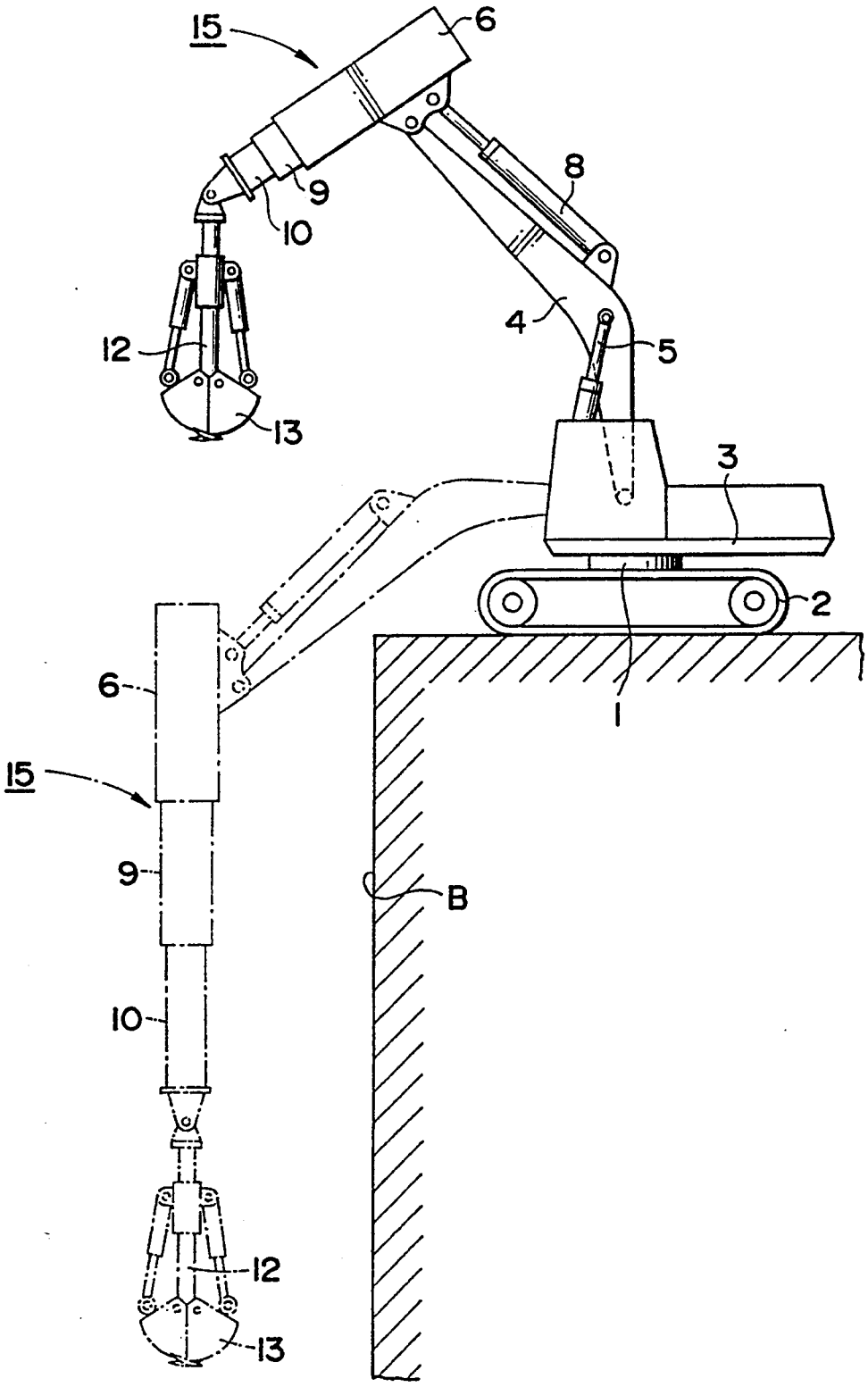
FIG. 7 is a view showing the operation of the first embodiment.

According to the first embodiment, the motor 61 is actuated to thereby drive the oil pump 60 so that oil under pressure is sucked from the oil tank 63 and is supplied to each component of the deep excavator, whereby each component can be operated. When the oil under pressure is supplied to the first and second hydraulic cylinders 5 and 8, the first and second hydraulic cylinders 5 and 8 are appropriately extended or contracted so that the boom 4 is vertically moved and the base arm 6 is also moved vertically relative to boom 4. As a result, the posture of the base arm 6 which is positioned slightly inclined as illustrated in solid lines of FIG. 7 is changed to the one which is directed perpendicularly to the earth as illustrated in broken lines of FIG. 7.

Described hereinafter is the operation to extend the stretchable arm 15, which is contracted as illustrated in solid lines of FIGS. 1 and 7. That is, described hereinafter is the operation to actuate the working unit 20 from the state as illustrated in solid lines of FIGS. 1, 3 and 7 so that the middle arm 9 is pulled out from the base arm 6 and the top arm 10 is pulled out from the middle arm 9.

Firstly, the directional control valve 62 is selected (rightwardly in FIG. 6) to the normal directional port or position so that the oil under pressure from the oil pump 60 is forced to flow toward the first pilot check valve 64. The oil under pressure passes the first pilot check valve 64 and enters the large rod 23 by way of the pressure application hose 32, and then enters the pressure chamber provided at the lower portion of the large cylinder 21 by way of the oil introduction hole 45 so that the oil under pressure pushes the piston 43 upward in the large cylinder 21. Accompanied by the sliding of the piston 43, the large rod 23 is also pushed upward in FIG. 4. However, the large rod 23 does not move relative to the base arm 6 since the upper end of the large rod 23 is coupled to the base arm 6 by the pin 26, but the large cylinder 21 per se is forced to move relatively downward. Accordingly, the middle arm 9 is forced to slide downward relative to the base arm 6 since the large and small cylinders 21 and 22 are respectively coupled to the middle arm 9 by the pin 30 which is inserted into the fixed block 29.

Since the piston 43 moves upward inside the large cylinder 21, the oil under pressure remaining in the discharge chamber of the large cylinder 21 flows out the port 46 and enters the pressure chamber of the small cylinder 22 through the synchronous pipe 31 and the port 47. Accordingly, the oil under pressure enters the pressure chamber of the small cylinder 22 and pushes the piston 53 downward inside the small cylinder 22. As a result, the small rod 24 together with the piston 53 move downward relative to the small cylinder 22. Since the lower end of the small rod 24 is coupled to the top arm 10 by the pin 27, when the small rod 24 is pushed out from the small cylinder 22, the top arm 10 is pushed out or downward from the middle arm 9. Successively, the oil under pressure remaining in the discharge chamber of the small cylinder 22 flows out from the port 55 and flows toward the second pilot check valve 65 by way of the return hose 33, the pressure pipe 34 and the pressure discharge hose 35. However, since the second pilot check valve 65 is closed, the pressure of the oil flowing toward the second pilot check valve 65 opens the relief valve 66 so that the oil under pressure passes the relief valve 66 and flows into the directional control valve 62 and thereafter returns to the pressure oil tank 63.

Since the pressure application cross-sectional area X of the large cylinder 21 is the same as that the pressure application cross-sectional area X of the small cylinder 22, and the flow rate of the oil under pressure which flows out from the port 46 is the same as that which flows into the port 47, the moving speed of the piston 43 is the same as that of the piston 53. Accordingly, the extending speed of the large rod 23 which is pushed out from the large cylinder 21 is the same as that of the small rod 24 which is pushed out from the small cylinder 22. As a result, the moving rate of the middle arm 9 relative to the base arm 6 becomes the same as that of the top arm 10 relative to the middle arm 9, so that the base, middle and top arms 6, 9, 10 constituting the stretchable arm 15 synchronously slide respective to one another at the same extending rate.

In such steps, the middle arm 9 is pushed out from the base arm 6 and the top arm 10 is pushed out from the middle arm 9 so that the entire length thereof is extended, which leads to extension of the entire length of the stretchable arm 15 as illustrated by the broken lines of FIG. 7. Thereafter, the lower end of the bucket 13 is forced to contact the bottom of the deep hole B. Then, the third and fourth hydraulic cylinders 14 are operated so that the bucket 13 is closed to excavate the earth and then hold the earth.

Described hereinafter is the operation of the deep excavator when the state wherein the entire length of the stretchable arm 15 is extended to excavate and hold the earth and sand by the bucket 13 is changed to a state wherein the stretchable arm 15 is contracted to pull out the bucket 13 from the deep hole B.

Firstly, the directional control valve 62 is switched (leftwardly in FIG. 6) to reverse directional port or position so that the oil under pressure from the oil pump 60 is supplied to the second pilot check valve 65. In this case, since the relief valve 66 is closed, the oil under pressure passes the second pilot check valve 65 and enters the discharge chamber of the small cylinder 22 by way of the pressure hose 35, the pressure hose 34 and the return hose 33. The pressure oil so entered in the discharge chamber pushes the piston 53 upwardly. Accordingly, the small rod 24 connected to the piston 53 is pulled into the small cylinder 22 so that the entire length of small cylinder 22 and the small rod 24 is contracted and the top arm 10 connected to the small rod 24 is pulled into the middle arm 9. Since the piston 53 slides toward the upper portion of the small cylinder 22, the oil under pressure remaining in the pressure chamber of the small cylinder 22 flows out from the port 47 and enters the discharge chamber of the large cylinder 21 by way of the synchronous pipe 31 and the port 46. The oil under pressure, which entered the discharge chamber of the large cylinder 21, pushes the piston 43 downward in the large cylinder 21. Accordingly, the large rod 23 connected to the piston 43 is pulled into the large cylinder 21 so that the entire length of the large cylinder 21 and the large rod 23 is contracted. Since the rod head 25 connected to the large rod 23 is connected to the base arm 6 and the working unit 20 is coupled to the middle arm 9 by the pin 30 of the fixed block 29, the working unit 20 is pulled upward toward the rod head 25 so that the middle arm 9 is pulled into the base arm 6 so as to be accommodated into the base arm 6. In such a manner, if the piston 43 slides downward in the large cylinder 21, the oil under pressure remaining in the pressure chamber of the large cylinder 21 enters the inside of the large rod 23 by way of the oil introduction hole 45 and passes through the large rod 23, and thereafter it passes through the pressure hose 32, the first pilot check valve 64 and thereafter is returned to the oil tank 63 by the directional control valve 62. Meanwhile, the flow rate of the oil under pressure at the state where the control valve 62 is positioned at the reverse directional port or position is lower than that at the state where the control valve 62 is positioned at the normal directional port or position. Accordingly, the contracting sliding speed of the piston 53 in the small cylinder 22 and the contracting sliding speed of the piston 43 in the large cylinder 21 are respectively slower than the extending sliding speed thereof.

Since the pressure application cross-sectional area Y of the pressure chamber of the small cylinder 22 is the same as the pressure application cross-sectional area X of the discharge chamber of the large cylinder 21, the moving speed of the piston 43 which is driven by the oil under pressure discharged from the pressure chamber of the small cylinder 22 is the same as the moving speed of the piston 53 relative to the small cylinder 22. Accordingly, the speed of the small rod 24 when it is pulled into the cylinder 22 becomes the same as that of the large rod 23 when it is pulled into the large cylinder 21 so that the moving rate of the middle arm 9 relative to the base arm 6 becomes the same as that of the top arm 10 relative to the middle arm 9. As a result, the contracting speed between the base, middle and top arms 6, 9 and 10 constituting the stretchable arm 15 becomes the same and each arm is operated synchronously with one another so that the entire length of the stretchable arm 15 is contracted. When the middle arm 9 and the top arm 10 are pulled in the base arm 6, the stretchable arm 15 is in the state illustrated in solid lines of FIGS. 1 and 7 so that the bucket 13 is pulled out on the ground from the deep hole B. Thereafter, the first and second hydraulic cylinders 5 and 8 are driven to incline the stretchable arm 15 so that the earth and sand excavated by and held by the bucket 13 can be discharged.

With repetition of the series operations, the earth can be successively excavated to form the deep hole B which is deep relative to its diameter. If the stretchable arm 15 is extended by switching the directional control valve 62 from the reverse to the normal directional port or position at the time of excavating the earth to form the deep hole B, the supply of the oil under pressure still continues after the bucket 13 contacts the bottom surface of the deep hole B so that the shell bucket 13 can push down against the bottom surface of the deep hole B. This leads to an increase in the amount of earth and sand to be excavated and held by the bucket 13.

As the present invention is structured as set forth above, the stretchable arm hanging the bucket can be extended and contracted by the working unit composed of a pair of hydraulic cylinders. Accordingly, it is possible to synchronously extend and contract each arm of the stretchable arm so that the extending and contracting speeds can be faster than those devices using a single hydraulic cylinder. Furthermore, since each arm of the stretchable arm is not connected with one another by wires or chains, the structure thereof becomes simple and there is no possibility of generation of trouble caused by the earth and sand since wires or chains are not exposed outside the stretchable arm. Still furthermore, since the deep excavator has such an arrangement that the other hydraulic cylinder is operated when the oil under pressure from one hydraulic cylinder enters the other hydraulic cylinder, the operating speed is increased as a whole and both hydraulic cylinders can be synchronous with each other so that each arm can be synchronously extended and contracted. Still furthermore, since the working unit comprises a pair of assembled hydraulic cylinders, the number of pressure hoses, which are to be entrained around or attached to each hydraulic cylinder, can be a minimum so that assembly and repair thereof can be made very easily.

Figure 8:
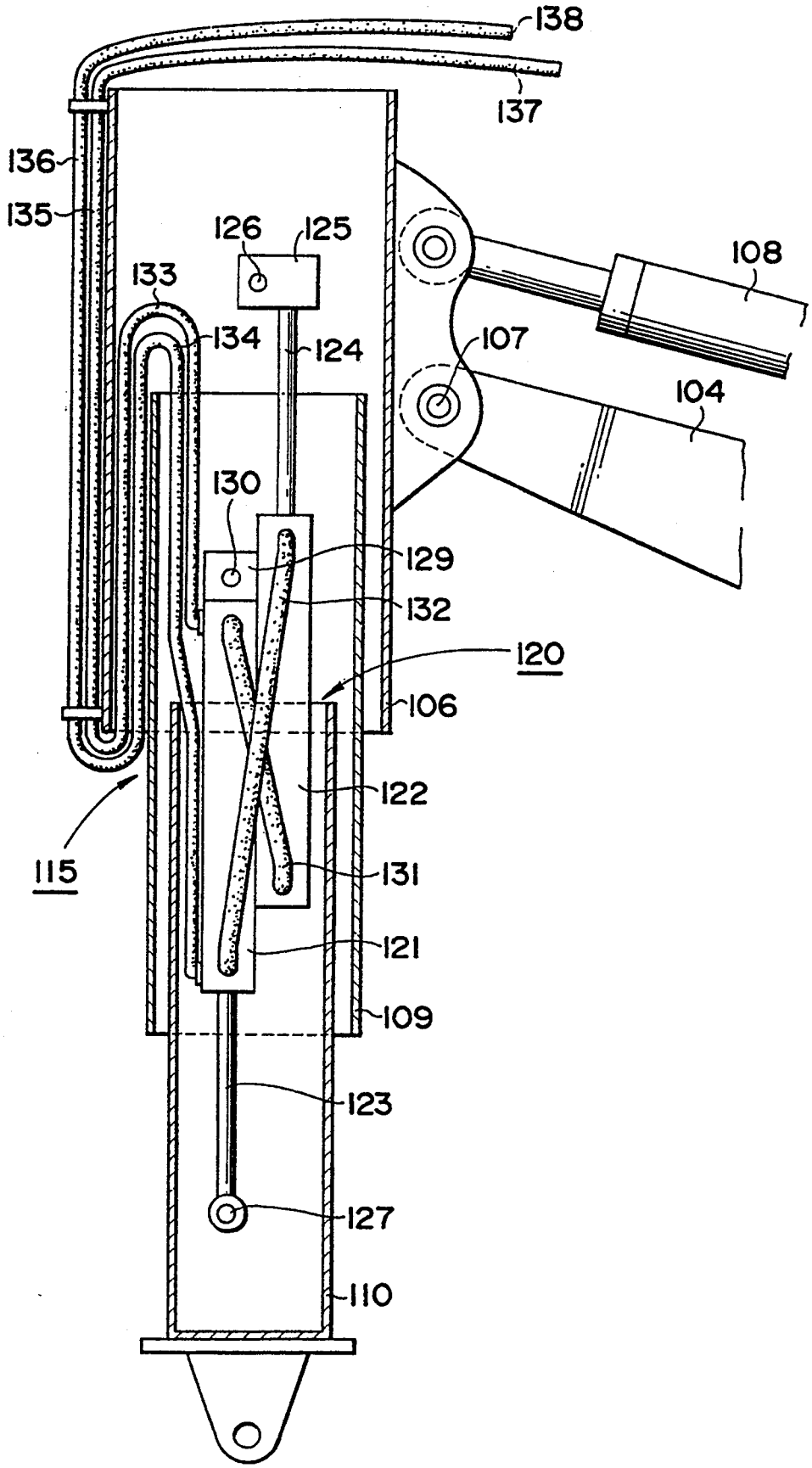
FIG. 8 is a sectional side view of the internal arrangement of a stretchable arm according to a second embodiment of the invention.
Figure 9:
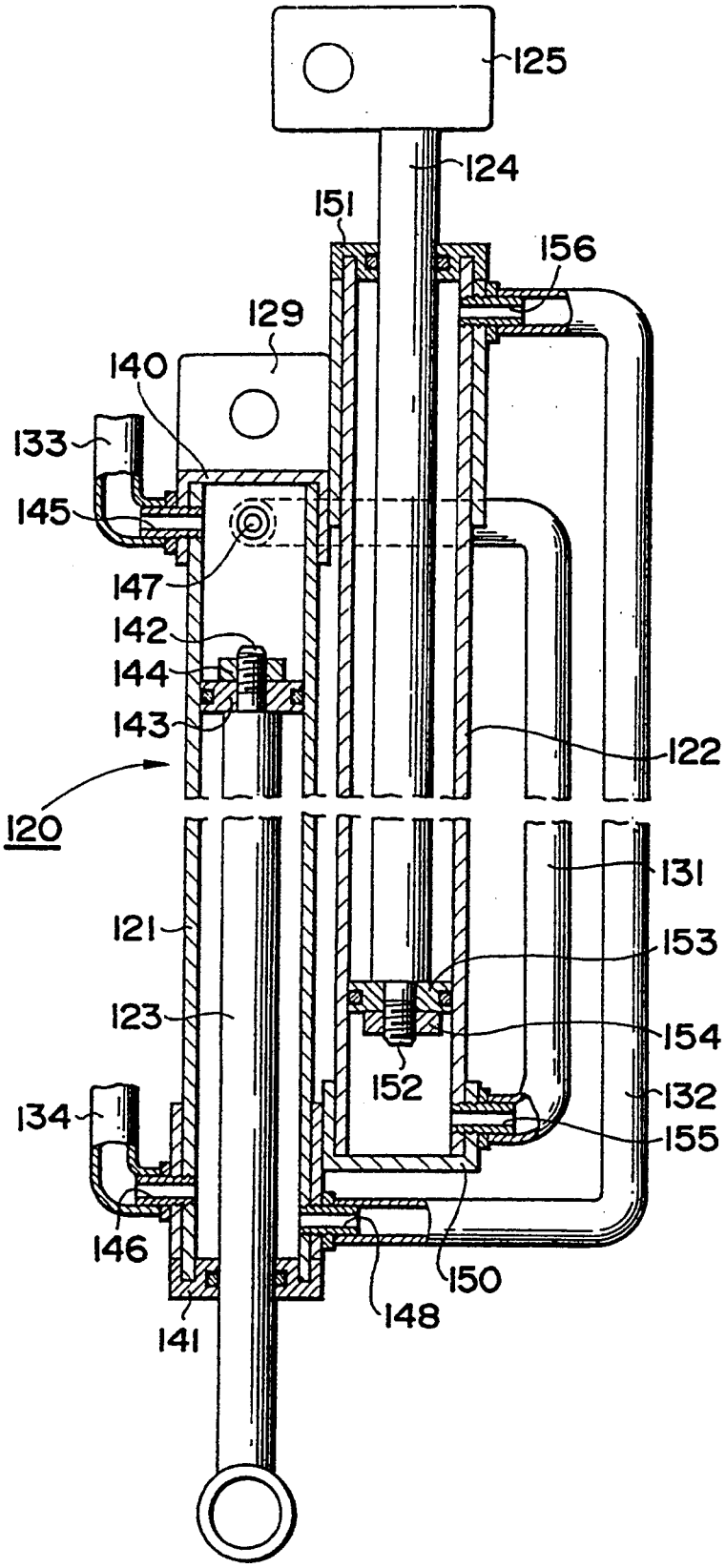
FIG. 9 is a cross-sectional view of the arrangement of a working unit according to the second embodiment.
Figure 10:
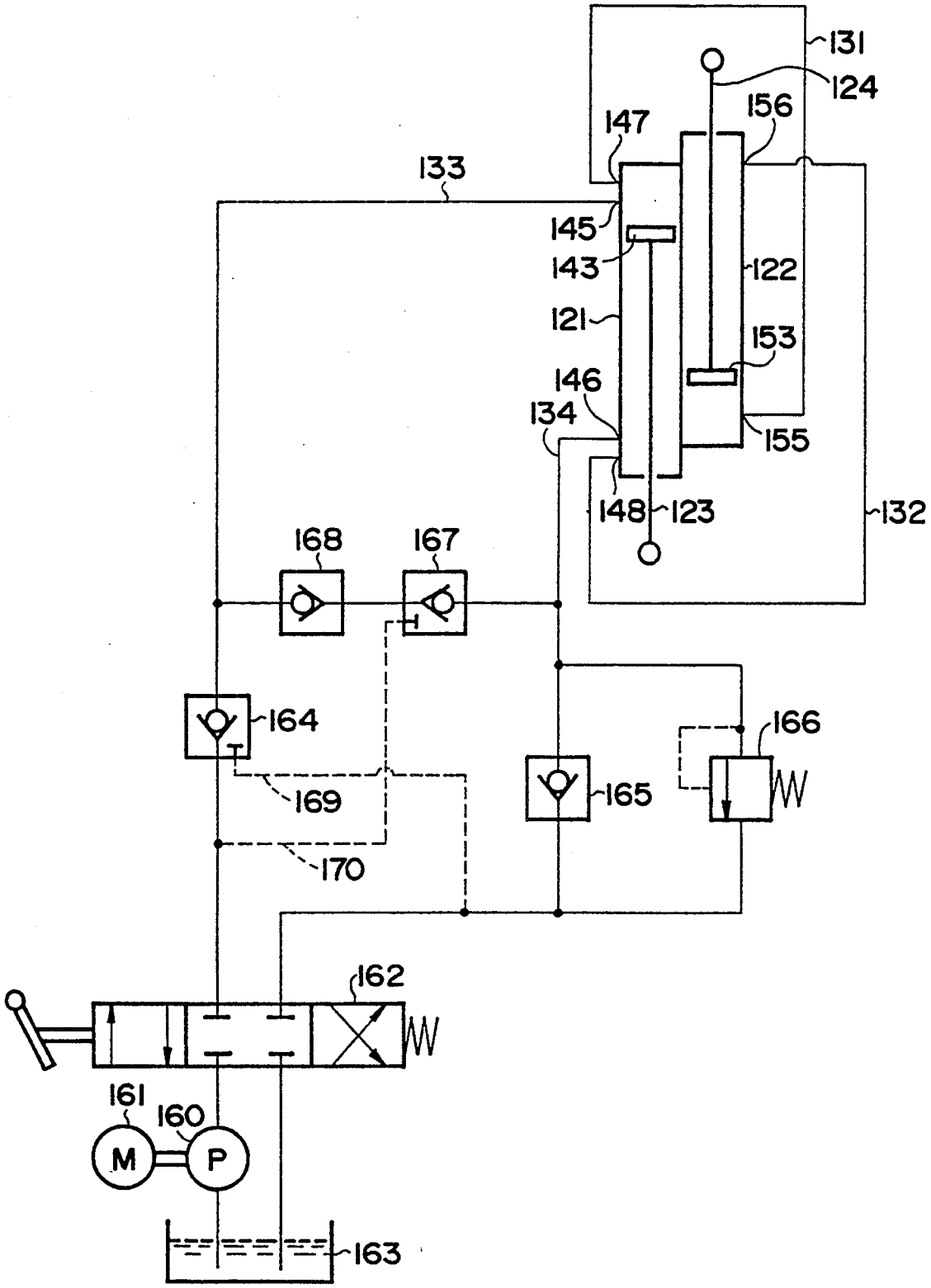
FIG. 10 is a diagrammatic view of a hydraulic system according to the second embodiment.

Second Embodiment (FIGS. 8 to 10)

A deep excavator according to a second embodiment will be described with reference to FIGS. 8 to 10. The arrangement of the deep excavator of the second embodiment is substantially the same as that of the first embodiment except that the sizes of the hydraulic cylinders disposed in the stretchable arm are the same and a merging means is additionally provided in the second embodiment, while the sizes of the hydraulic cylinders are different from each other in the first embodiment.

As shown in FIG. 8, the stretchable arm 115 includes a top arm 110 inserted into the middle arm 109 and the middle arm 109 inserted into a base arm 106, and these arms are assembled whereby the top and middle arms 110 and 109 respectively slide in the middle and base arms 109 and 106 in the longitudinal directions thereof. A working unit 120 comprising fifth and sixth hydraulic cylinders 121 and which have the same sizes are arranged in parallel with each other in the axial directions thereof. The fifth and sixth hydraulic cylinders 121 and 122 are fixed to the middle arm 109 so as to be integrated with each other while their working directions are opposite to each other. A fifth cylinder rod 123 of the fifth hydraulic cylinder 121 is directed downward and a sixth cylinder rod 124 of the sixth hydraulic cylinder 122 is directed upward. A block 129 is fixed to the rear end of the fifth cylinder 121 and is coupled to the middle arm 109 by a pin 130. Accordingly, the working unit 120 moves together with the middle arm 109. The fifth cylinder rod 123 extends downward from the lower end of the fifth hydraulic cylinder 121 and is coupled to the top arm 110 by a pin 127 at the lower end thereof. A block-shaped rod head 125 is fixed to the upper end of the sixth cylinder rod 124 which is directed upward from the upper end of the sixth hydraulic cylinder 122 and is coupled to the base arm 106 by a pin 126.

The pressure chambers of the fifth and sixth hydraulic cylinders 121 and 122 communicate with each other by a synchronous pipe 131 which is exposed outside the working unit 120. The discharge chambers of the fifth and sixth hydraulic cylinders 121 and 122 communicate with each other by a synchronous pipe 132 which is exposed outside the working unit 120. Accordingly, the pressure chambers and the discharge chambers of the fifth and sixth hydraulic cylinders 121 and 122 respectively communicate with each other. The pressure chamber of the fifth hydraulic cylinder 121 is connected to and communicates with the tip end of a pressure hose 133 and the discharge chamber of the fifth hydraulic cylinder 121 is connected to and communicates with the tip end of a return hose 134. The other ends of the pressure hose 133 and the return hose 134 are respectively connected to one ends of pressure pipes 135 and 136 which are respectively fixed to the outer surface of the base arm 106. Both the pressure pipes 135 and 136 are respectively fixed to and in parallel with the base arm 106 and disposed in parallel with and outside the base arm 106. The pressure pipes 135 and 136 have upper ends respectively connected to flexible connecting hoses 137 and 138 which are formed of resin and through which the oil under pressure flow. Both the pressure hose 133 and the return hose 134 have respectively enough length to be flexible when they are respectively accommodated in the stretchable arm 115 so that they do not hinder the sliding motion of the top and middle arms 110 and 109 even if the top arm 110 and the middle arm 109 respectively slide vertically in the base arm 106.

FIG. 9 illustrates the internal arrangement of the working unit 120. The fifth hydraulic cylinder 121 is shaped as a round pipe and the inside is hollow and upper and lower ends thereof are open. A closing cap 140 engages airtightly with the upper end opening of the fifth hydraulic cylinder 121 for closing the upper end opening. A cap 141, which has a sliding hole at the center thereof, engages with the lower end opening of the fifth hydraulic cylinder 121. The fifth cylinder rod 123 is airtightly slidable inserted into the sliding hole of the cap 141. The fifth cylinder rod 123 per se is hollow inside thereof and has a shape of a round pipe. A fixed bolt 142 having a screw at the outer periphery thereof is fixed to the tip end of the upper end of the fifth cylinder rod 123. The fixed bolt 142 is inserted into a piston 143 which airtightly slidably contacts the inner surface of the fifth hydraulic cylinder 121. The piston 143 is connected to the fifth cylinder rod 123 by a nut 144 which screws on the fixed bolt 142. The inside of the fifth hydraulic cylinder 121 is separated into upper and lower airtight chambers by slidably inserting the piston 143 into the fifth hydraulic cylinder 121, wherein the former is called the pressure chamber and the latter is called the discharge chamber.

Likewise, the sixth hydraulic cylinder 122 is shaped as a round pipe and the inside is hollow and upper and lower ends thereof are open. A closing cap 150 engages airtightly with the lower end opening of the sixth hydraulic cylinder 122 for closing the lower end opening. A cap 151, which has a sliding hole at the center thereof, engages with the upper end opening of the sixth hydraulic cylinder 122. The sixth cylinder rod 124 is airtightly slidably inserted into the sliding hole of the cap 151. A fixed bolt 152 having a screw at the outer periphery thereof is fixed to the tip end of the lower end of the sixth cylinder rod 124. The fixed bolt 152 is inserted into a piston 153 which airtightly slidably contacts the inner surface of the sixth hydraulic cylinder 122. The piston 153 is connected to the small rod 124 by a nut 154 which screws onto the fixed bolt 152. The inside of the sixth hydraulic cylinder 122 is separated into upper half and lower airtight chambers by slidably inserting the piston 153 into the sixth hydraulic cylinder 122, wherein the former is called the discharge chamber and the latter is called the pressure chamber.

A port 145 is provided at the upper side surface of the fifth hydraulic cylinder 121 for communicating with the pressure chamber of the fifth hydraulic cylinder 121. A port 146 is provided at the lower side surface of the fifth hydraulic cylinder 121 for communicating with the discharge chamber of the fifth hydraulic cylinder 121. One end of the supply hose 133 and return hose 134 are connected respectively to the port 145 and 146. A port 147 is provided at the upper side surface of the fifth hydraulic cylinder 121 for communicating with the pressure chamber and a port 148 is provided at the lower side surface of the fifth hydraulic cylinder 121 for communicating with the discharge chamber thereof. A port 155 is provided at the lower side surface of the sixth hydraulic cylinder 122 for communicating with the pressure chamber and a port 156 is provided at the upper side surface of the sixth hydraulic cylinder 122 for communicating with the discharge chamber thereof. The ports 147 and 155 are connected with each other 155 by way of a synchronous pipe 131 and the ports 148 and 156 are connected with each other by way of a synchronous pipe 132.

FIG. 10 shows a hydraulic circuit according to the second embodiment of the invention. In FIG. 10, a pressure oil pump 160 is driven by a motor 161 and has a suction side which communicates with oil tank 163 and a discharge side which is connected to a directional control valve 162. The directional control valve 162 is connected to one end of the pressure hose 133 by way of a first pilot check valve 164. The other end of the pressure hose 133 communicates with the port 145 of the fifth hydraulic cylinder 121. The return hose 134 is connected to the port 146 of the fifth hydraulic cylinder 121 and is also connected to the directional control valve 162 by way of a first inline check valve 165. A relief valve 166 is connected in parallel with the first inline check valve 165 and also connected to the return hose 134 and the directional control valve 162. A second pilot check valve 167 and a second inline check valve 168 are connected in series with each other between the pressure application hose 133 and the first pilot check valve 164 and between the return hose 134 and the first inline check valve 165. Oil pressure control direction of the second pilot check valve 167 is opposite to that of the second inline check valve 168. When the directional control valve 162 is positioned at the normal directional position, the oil under pressure from the directional control valve 162 does not flow into the second pilot valve 167 and the second inline check valve 168. A pressure line 169 is connected to a control port of the first pilot check valve 164 for supplying oil pressure from the first inline check valve 165 while a pressure line 170 is connected to a control port of the second pilot check valve 167 for supplying oil pressure from the first pilot check valve 164. The second pilot check valve 167 and the second inline check valve 168 constitute a merging means.

The operation of the second embodiment will now be described.

When the motor 161 is actuated to drive the pressure oil pump 160, the oil is sucked from the oil tank 163 and is supplied to each component of the deep excavator, whereby each component can be operated. When the oil under pressure is supplied to the first and second hydraulic cylinders 105 and 108, the first and second hydraulic cylinders 105 and 108 are appropriately extended or contracted so that the boom 104 is vertically moved and the base arm 106 is also moved vertically. As a result, the posture of the base arm 106 is changed in the same way as the first embodiment as illustrated in FIG. 7.

Described hereinafter is the operation to extend the stretchable arm 115.

Firstly, the directional control valve 162 is positioned at the normal directional position (rightwardly in FIG. 10), the oil under pressure discharged from the pressure oil pump 160 is forced to flow into the first pilot check valve 164. Since the first pilot check valve 164 is positioned at the normal directional position, the oil under pressure passes the first pilot check valve 164 and is supplied to the fifth hydraulic cylinder 121 by way of the pressure hose 133 and the port 145. The oil under pressure which is supplied to the fifth hydraulic cylinder 121 is expanded in the pressure chamber so that it pushes the piston 143 downward in FIG. 9 whereby the first cylinder 123 is moved downward. The oil under pressure which is supplied to the pressure chamber of the fifth hydraulic cylinder 121 is also supplied to the pressure chamber of the sixth hydraulic cylinder 122 by way of the port 147, the synchronous pipe 131 and the port 155. Accordingly, since the oil under pressure is expanded in the pressure chamber of the fifth hydraulic cylinder 121, the piston 153 is pushed upward in FIG. 9 to thereby push the sixth cylinder rod 124 upward. As a result, the rod 123 protrudes downward from the fifth cylinder 121 while the rod 124 protrudes upward from the sixth hydraulic cylinder 122. At this time, the fifth hydraulic cylinder 121 is fixed to the middle arm 109 and the fifth cylinder rod 123 is fixed to the top arm 110, the top arm 110 is pushed from the middle arm 109 when the fifth cylinder rod 123 extends relative to the fifth hydraulic cylinder 121. Furthermore, although the sixth cylinder rod 124 is pushed by the sixth hydraulic cylinder 122, the sixth hydraulic cylinder 122 is fixed to the middle arm 109 and the sixth cylinder rod 124 is fixed to the base arm 106 so that the sixth cylinder rod 124 does not move relative to the base arm 106. Accordingly, the middle arm 109 is relatively pushed from the base arm 106. As a result, both the middle and tops 109 and 110 move downward relative to the base arm 106 so that both the middle and top arms 109 and 110 simultaneous extend.

When the fifth and sixth pistons 143 and 153 slide downward and upward in the fifth and sixth hydraulic cylinders 121 and 122, the oil under pressure remaining in the discharge chambers of the fifth and sixth hydraulic cylinders 121 and 122 is pushed from the fifth and sixth hydraulic cylinders 121 and 122. The oil under pressure in the discharge chamber of the hydraulic cylinder 122 enters the discharge chamber of the hydraulic cylinder 121 by way of the port 156, the synchronous pipe 132 and the port 148 and thus merges into the oil under pressure in the discharge chamber of the hydraulic cylinder 121, then the merged oil under pressure flows out from the port 146 and is discharged through the return hose 134. The oil under pressure in the discharge chambers of the fifth and sixth hydraulic cylinders 121 and 122, which is so discharged from the return hose 134, is directed toward the first inline check valve 165. Since the first inline check valve 165 is directed opposite to the flow of the oil under pressure from the return hose 134, the oil under pressure cannot flow toward the directional control valve 162 through the first inline check valve 165. However, the oil under pressure from the oil pressure pump 160 is supplied to the second pilot check valve 167 as a pilot pressure by way of the pressure line 170 so that the second pilot check valve 167 is open. Accordingly, the oil under pressure from the return hose 134 passes the second pilot check valve 167 and thereafter passes the second inline check valve 168 which is directed conforming to the flow of oil under pressure from the return hose 134. The oil under pressure from the return hose 134 which passed the second inline check valve 168 merges into the oil under pressure which is supplied from the pressure oil pump 160 at a point past the first pilot check valve 164 and flows through the pressure hose 133. Since the oil under pressure from the oil pump 160 and that of the discharge chambers of the sixth hydraulic cylinders 121 and 122 merge into one, the amount of oil under pressure which is supplied to the pressure hose 133 is increased by the amount corresponding to the oil under pressure discharged from the discharge chambers of the fifth and sixth hydraulic cylinders 121 and 122. The increased amount of oil under pressure is supplied to the pressure chambers of the fifth and sixth hydraulic cylinders 121 and 122. Since the merged oil under pressure is supplied to the pressure chambers of the fifth and sixth hydraulic cylinders 121 and 122, the moving speeds of the fifth and sixth pistons 143 and 153 in the downward or upward directions are increased and at the same time the moving speeds of the fifth and sixth cylinder rods 123 and 124 are also increased. Accordingly, the middle and top arms 109 and 110 constituting the stretchable arm 115 are extended at high speed from the base arm 106. However, when the pressure of the oil under pressure which flows out from the discharged chambers of the fifth and sixth hydraulic cylinders 121 and 122 is abnormally high and the same pressure is applied to the first inline check valve 165 by way of the return hose 134, the pressure relief valve 166 opens so that the oil under pressure flows into the directional control valve 162 and it is returned to the oil tank 163. In such a manner, the relief valve 166 prevents the hydraulic circuit from being damaged due to abnormal pressure applied to the first inline check valve 165.

In such steps, when the oil under pressure from the pressure oil pump 160 is supplied to the pressure chambers of the fifth and sixth hydraulic cylinders 121 and 122 by way of the first pilot check valve 164 and the pressure hose 133, the oil under pressure flowed out from the discharge chambers of the fifth and sixth hydraulic cylinders 121 and 122 merges and is supplied again into the fifth and sixth hydraulic cylinders 121 and 122 so that the sliding speeds of both the fifth and sixth cylinder rods 123 and 124 are increased. This leads to the extension of the entire length of the stretchable arm 115 in the same manner as the first embodiment as illustrated by broken lines in FIG. 7. Thereafter, the lower end of the bucket 113 is forced to contact the bottom of the deep hole B. Then, the third and fourth hydraulic cylinders 114 are operated so that the bucket 113 is closed to excavate the earth.

Described hereinafter is the operation when the stretchable arm 115 is contracted.

Firstly, the directional control valve 162 is switched to the reverse directional port or position (leftwardly in FIG. 10) so that the oil under pressure from the pressure oil pump 160 is supplied to the first inline check valve 165. Since the first inline check valve 165 is directed conforming to the flow of the oil under pressure from the pressure oil pump 160, the oil under pressure passes the first inline check valve 165 and enters the discharge chamber of the fifth hydraulic cylinder 121 by way of the return hose 134 and the port 146. At this time, since no pilot pressure is applied to the second pilot check valve 167 and the second pilot check valve 167 is directed opposite to the flow of the oil under pressure which passed the first inline check valve 165, the oil under pressure which passed the first inline check valve 165 does not pass the second pilot check valve 167. The oil under pressure which entered the discharge chamber of the fifth hydraulic cylinder 121 pushes the piston 143 upward so that the fifth cylinder rod 123 can be pulled into the fifth hydraulic cylinder 121. Accordingly, the top arm 110 is pulled into the middle arm 109. The oil under pressure which entered the discharge chamber of the fifth hydraulic cylinder 121 also enters the discharge chamber of the sixth hydraulic cylinder 122 by way of the port 148, the synchronous pipe 132 and the port 156 and it is expanded in the discharge chamber of the sixth hydraulic cylinder 122 so that the piston 153 is pushed downward and the sixth cylinder rod 124 is pulled into the sixth hydraulic cylinder 122. As a result, the middle arm 109 is pulled into the base arm 106. In such a manner, the middle arm 109 and the top arm 110 are respectively pulled into the base arm 106 so that the entire length of the stretchable arm 115 is contracted and the bucket 113 is pushed upward.

Since the piston 153 is pushed downward in the sixth hydraulic cylinder 122, the oil under pressure remaining in the sixth hydraulic cylinder 122 enters the pressure chamber of the fifth hydraulic cylinder 121 by way of the port 155, the synchronous pipe 131 and the port 147. At the same time, since the piston 143 is pushed upward in the fifth hydraulic cylinder 121, the oil under pressure in the pressure chamber of the fifth hydraulic cylinder 121 merges into the oil under pressure which entered the same pressure chamber from the pressure chamber of the sixth hydraulic cylinder 122. The merged oil under pressure flows toward the first pilot check valve 164 by way of the port 145 and the pressure hose 133. In the first pilot check valve 164, since the oil pressure is applied to the first pilot check valve 164 from the first inline check valve 165 by way of the pressure line 169 and the first pilot check valve 164 is open, the oil under pressure from the pressure hose 133 passes the first pilot check valve 164 and returns to the oil tank 163 by way of the directional control valve 162. In this case, since the oil under pressure from the pressure oil pump 160 is supplied to the discharge chambers of the fifth and sixth hydraulic cylinders 121 and 122, neither the speed of the fifth cylinder rod 123 when it is pulled into the fifth hydraulic cylinder 121 nor the speed of the sixth cylinder rod 124 when it is pulled into the sixth hydraulic cylinder 122 is increased. However, since the pressure application cross-sectional areas of the pistons 143 and 153 in the discharge chambers of the fifth and sixth hydraulic cylinders 121 and 122 are respectively reduced by the cross-sectional areas of the fifth and sixth cylinder rods 123 and 124, they are smaller than the pressure application cross-sectional areas of the pressure chambers of the fifth and sixth hydraulic cylinders 121 and 122. Accordingly, if the amount of oil under pressure discharged from the pressure oil pump 160 is constant, the sliding speeds of the pistons 143 and 153 when they are pulled into the fifth and sixth hydraulic cylinders 121 and 122 are faster than those when they are pulled out from the fifth and sixth hydraulic cylinders 121 and 122.

When the middle arm 109 and the top arm 110 constituting the stretchable arm 115 are accommodated into the base arm 106 so that the entire length of the stretchable arm 115 is contracted, the posture of the stretchable arm 115 is changed in the same manner as the first embodiment as illustrated in FIGS. 1 and 7 so that the bucket 113 is pulled out on the ground from the deep hole B. Thereafter, the first and second hydraulic cylinders 105 and 108 are driven to incline the stretchable arm 115 so that the earth and sand excavated by and held by the bucket 113 can be discharged to the bed of a truck, etc.

With repetition of the series of operations, the earth can be successively excavated to form the deep hole B. If the stretchable arm 115 is extended by switching the directional control valve 162 from the reverse to the normal directional port or position at the time of excavating the earth to form the deep hole B, the supply of the oil under pressure still continues after the bucket 113 contacts the bottom surface of the deep hole B so that the bucket 113 can push down the bottom surface of the deep hole B. This increases the amount of earth and sand to be excavated and held by the bucket 113.

Third Embodiment (FIGS. 11 to 13):

A deep excavator according to a third embodiment will be described with reference to FIGS. 11 to 13. The third embodiment is substantially the same as the second embodiment except for the arrangement of the working unit. The components in the third embodiment which are the same as those of the second embodiment are denoted by the same numerals and the explanations thereof are omitted.

Figure 11:
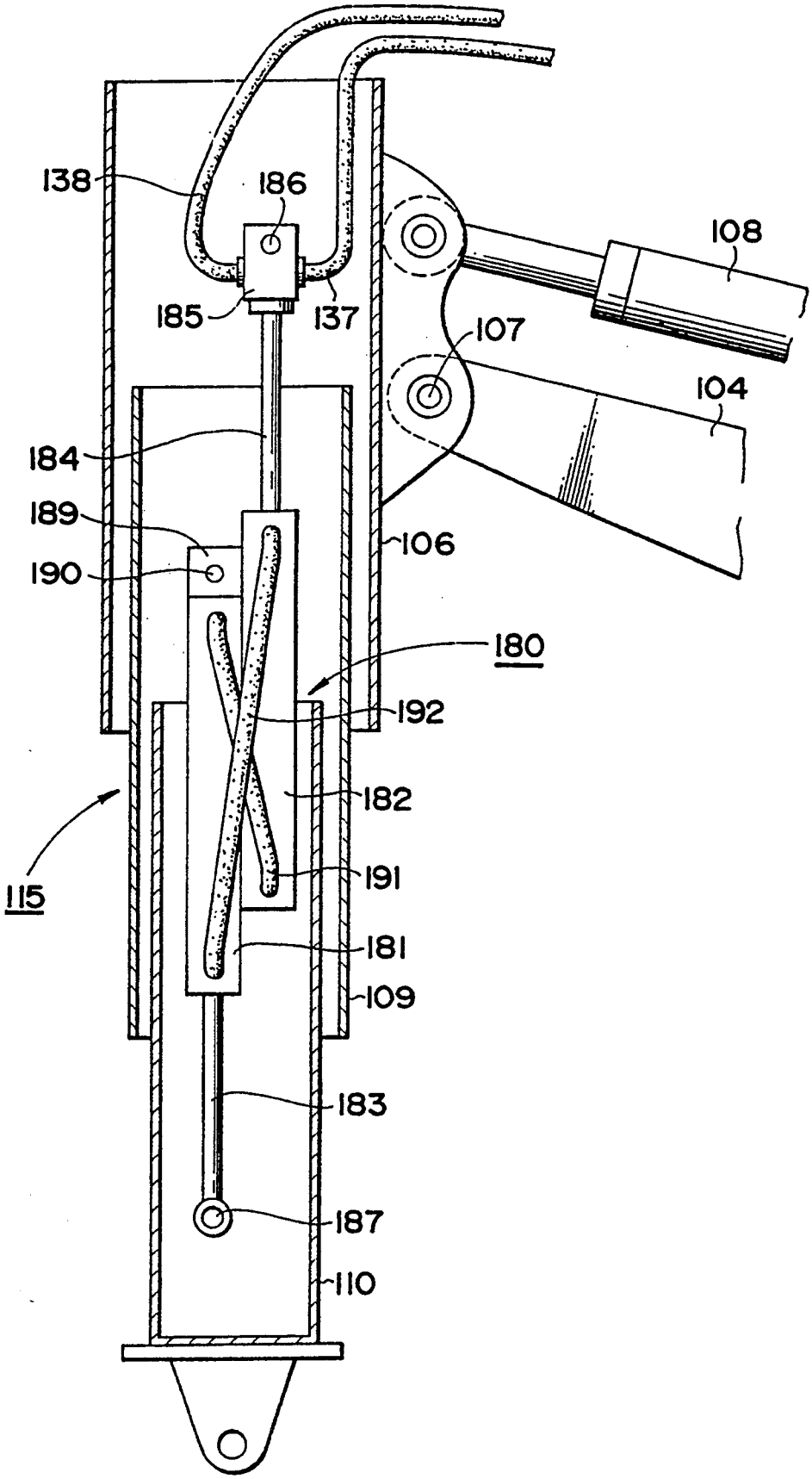
FIG. 11 is a cross-sectional view of the internal arrangement of the stretchable arm according to a third embodiment of the present invention.

In FIG. 11 showing a cross-section of the internal arrangement of the stretchable arm 115, the top arm 110 is inserted into the middle arm 109 and the middle arm 109 is inserted into the base arm 106 and these arms are assembled whereby the top and middle arms 110 and 109 respectively slide in the middle and base arms 109 and 106 in the longitudinal directions thereof. A working unit 180 comprises one and the other hydraulic cylinders 181 and 182 which have the same size. The one hydraulic cylinder 181 and the other hydraulic cylinder 182 are arranged in parallel with each other in the axial directions thereof and are fixed to the middle arm 109 so as to be integrated with each other while their working directions are opposite to each other. A cylinder rod 183 of the one hydraulic cylinder 181 is directed downward and a cylinder rod 184 of the other hydraulic cylinder 182 is directed upward. A block 189 is fixed to the rear end of the one hydraulic cylinder 181 and it is coupled to the middle arm 109 by a pin 190. Accordingly, the working unit 180 moves together with the middle arm 109. The one cylinder rod 183 extends downward from the lower end of the one hydraulic cylinder 181 and is coupled to the top arm 110 by a pin 187 at the lower end thereof. A block-shaped rod head 185 is fixed to the upper end of the other cylinder rod 184 which is directed upward from the upper end of the other hydraulic cylinder 182 and is coupled to the base arm 106 by a pin 186.

Pressure chambers of the hydraulic cylinders 181 and 182 communicate with each other by a synchronous pipe 191 which is exposed outside the working unit 180. Discharge chambers of the hydraulic cylinders 181 and 182 communicate with each other by a synchronous pipe 192 which is exposed outside the working unit 180. Accordingly, the pressure chambers and the discharge chambers of the hydraulic cylinders 181 and 182 communicate with each other. Furthermore, connecting hoses 137 and 138 are connected to the rod head 185 at the right and left thereof. The oil under pressure is supplied to the hydraulic cylinders 181 and 182 by way of the connecting hoses 137 and 138 so that each component of the working unit 180 operates.

Figure 12:
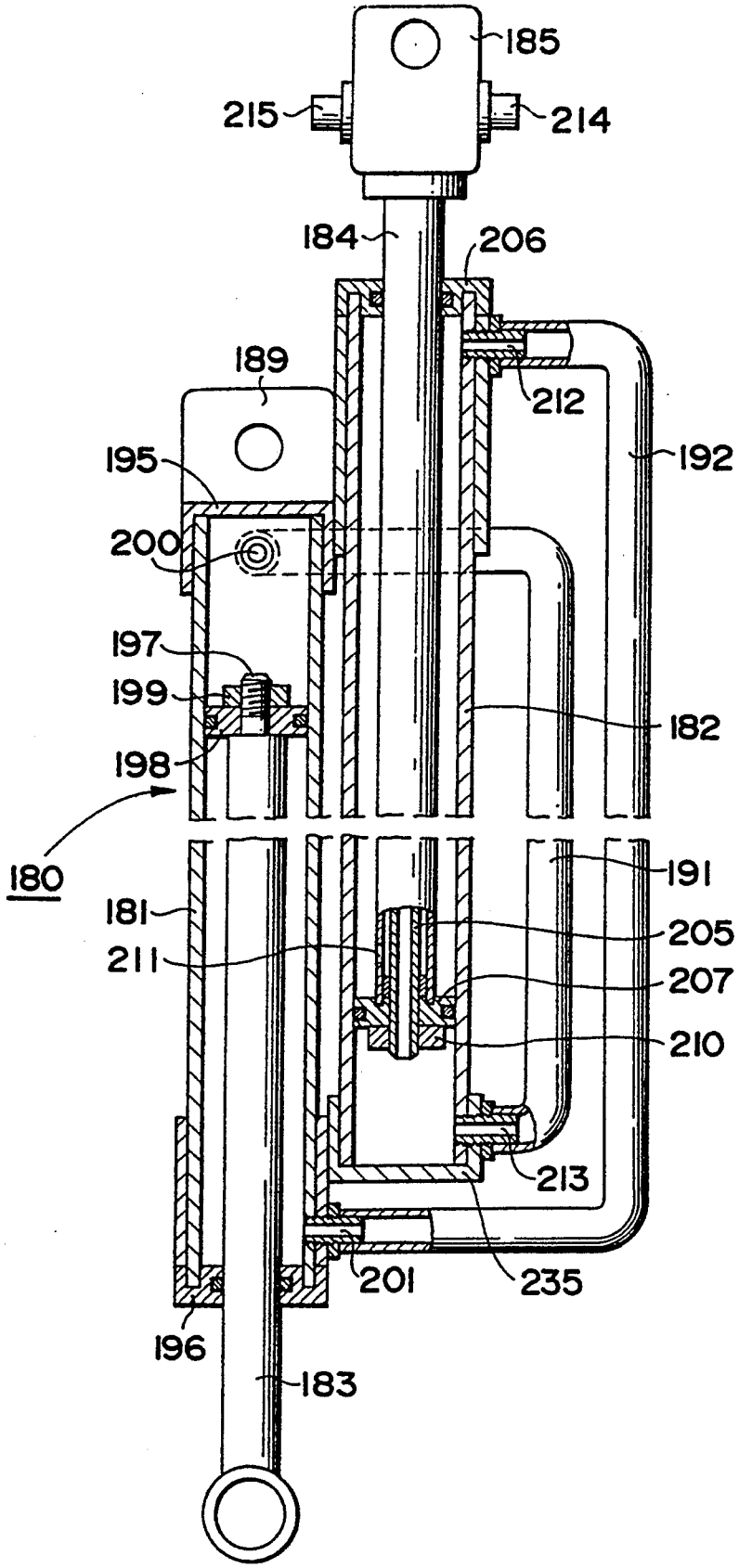
FIG. 12 is a cross-sectional view of the arrangement of a working unit according to the third embodiment.
Figure 13:
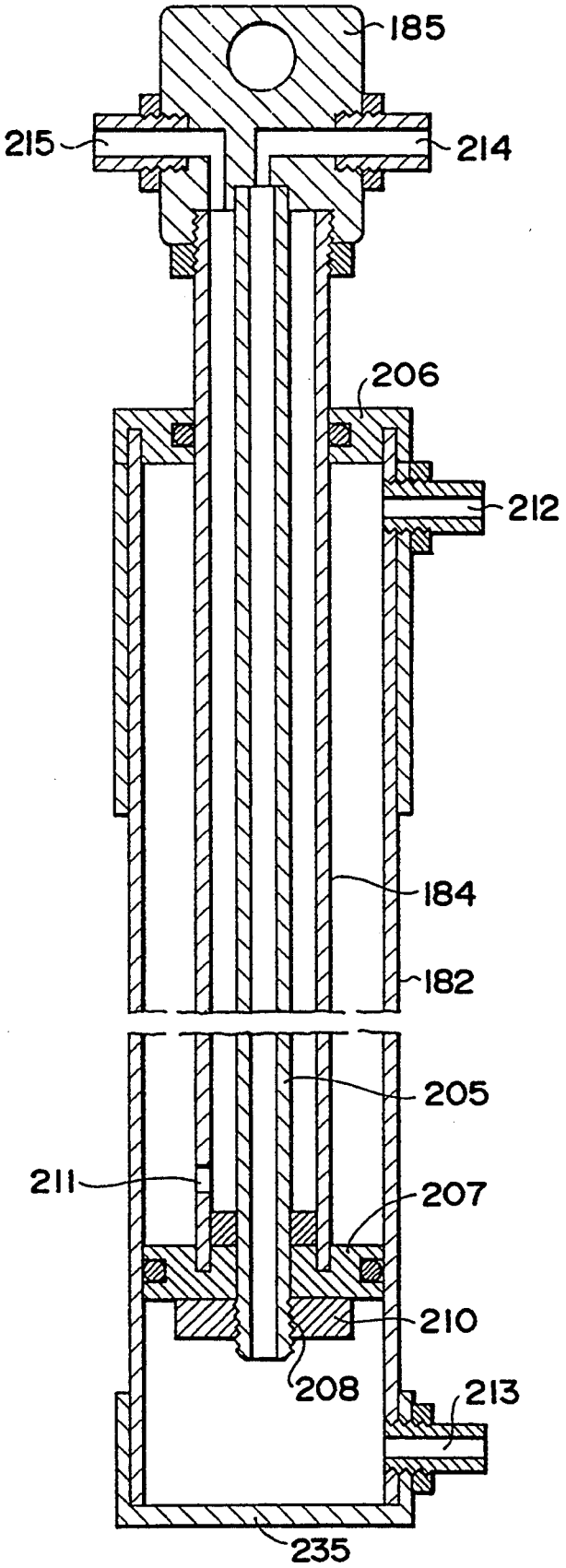
FIG. 13 is a cross-sectional view of the arrangement of a hydraulic cylinder according to the third embodiment.

FIG. 12 illustrates the internal arrangement of the working unit 180. The one hydraulic cylinder 181 has a shape of a round pipe and an inside which is hollow and upper and lower ends which are open. A closing cap 195 engages airtightly with the upper end opening of the hydraulic cylinder 181 for closing the same upper end opening. A cap 196, which has a sliding hole at the center thereof, engages with the lower end opening of the one hydraulic cylinder 181. The one cylinder rod 183 is airtightly slidably inserted into the sliding hole of the cap 196. The cylinder rod 183 per se is hollow inside and has a shape of a round pipe. A fixed bolt 197 having a screw at the outer periphery thereof is fixed to the tip end of the upper end of the one cylinder rod 183. The fixed bolt 197 is inserted into a piston 198 which airtightly slidably contacts the inner surface of the one hydraulic cylinder 181. The piston 198 is connected to the one cylinder rod 183 by way of a nut 199 which screws onto the fixed bolt 197. The inside of the one hydraulic cylinder 181 is separated into upper and lower airtight chambers by slidably inserting the piston 198 into the one hydraulic cylinder 181, wherein the former is called the pressure chamber and the latter is called the discharge chamber.

A port 200, which communicates with the pressure chamber of the one hydraulic cylinder 181, is provided at the upper side surface of the one hydraulic cylinder 181 and a port 201, which communicates with the discharge chamber of the one hydraulic cylinder 181, is provided at the lower side surface of the one hydraulic cylinder 181. The port 200 is connected to one end of the synchronous pipe 191 and the port 201 is connected to one end of the synchronous pipe 192.

Likewise, the other hydraulic cylinder 182 has a shape of a round pipe and an inside which is hollow and upper and lower ends which are open. A closing cap 235 engages airtightly with the lower end opening of the other hydraulic cylinder 182 for closing the lower end opening. A cap 206, which has a sliding hole at the center thereof, engages with the upper end opening of the other hydraulic cylinder 182. The other cylinder rod 184 is airtightly slidably inserted into the sliding hole of the cap 206. A middle pipe 205 having an outer diameter which is smaller than the inner diameter of the other cylinder rod 184 is inserted coaxially into the other cylinder rod 184. The middle pipe 205 has a screw portion 208 at the outer periphery of the lower end thereof. The middle pipe 205 is inserted into a piston 207 which is slidable along and airtightly contacts the inner peripheral surface of the other hydraulic cylinder 182.

The piston 207 is connected to the middle pipe 205 by a nut 210 which is screwed into the screw portion 208 of the middle pipe 205. As the piston 207 is slidable inserted into the other hydraulic cylinder 182, the inside of the other hydraulic cylinder 182 is separated into upper and lower airtight chambers, wherein the former is called the discharge chamber and the latter is called the pressure chamber. A through hole 211 opens through the lower portion of the other cylinder rod 184 for communicating with the inner and outer peripheries of the other cylinder rod 184.

A rod head 185 is airtightly connected to the upper end of the other cylinder rod 184 and the upper end of the middle pipe 205 is airtightly connected to the rod head 185. Accordingly, double spaces or passages which are arranged concentrically are defined in the other cylinder rod 184. However, the double spaces do not communicate with each other. The lower end of the middle pipe 205 communicate with the pressure chamber of the hydraulic cylinder 182 by way of the opening provided therein. The space defined between the inside of the rod head 185 and the outside of the middle pipe 205 communicates with the discharge chamber of the hydraulic cylinder 182 by way of the through hole 211. The other cylinder rod 184 has a port 214 communicating with the inside of the middle pipe 205 and a port 215 communicating with the space defined between the inside of the other cylinder rod 184 and the outside of the middle pipe 205. The connecting hose 137 is connected to the port 214 and the connecting hose 138 is connected to the port 215.

The other hydraulic cylinder 182 has a port 213 at the lower side surface thereof for communicating with the pressure chamber thereof and a port 212 at the upper side surface thereof for communicating with the discharge chamber thereof. The port 213 is connected to one end of the synchronous pipe 191 and the port 212 is connected to one end of the synchronous pipe 192.

According to the third embodiment, the oil under pressure supplied from the oil pressure tank 163 is supplied to the working unit 180 by way of the connecting hoses 137 and 138. In this case, when the oil under pressure is supplied from the connecting hose 137, it flows into the pressure chamber of the other hydraulic cylinder 182 by way of the port 214, and the middle pipe 205 and is expanded in the same pressure chamber. Accordingly, both the piston 207 and the other cylinder rod 184 slide upward in the other hydraulic cylinder 182 whereby the middle arm 109 is pulled out from the base arm 106 since the other cylinder rod 184 is coupled to the base arm 106 and the other hydraulic cylinder 182 is coupled to the middle arm 109. At the same time, the oil under pressure is also supplied to the pressure chamber of the one hydraulic cylinder 181 by way of the port 213, the synchronous pipe 191 and the port 200 and it is expanded in the same pressure chamber. Accordingly, the piston 198 slides downward in the one hydraulic cylinder 181 while both the piston 198 and the one cylinder rod 183 are pushed downward so that the one cylinder rod 183 is forced to protrude from the one hydraulic cylinder 181. Since the middle arm 109 is coupled to the one hydraulic cylinder 181 and the top arm 110 is coupled to the one hydraulic cylinder rod 183, the interval therebetween is increased so that the top arm 110 is pushed out from the middle arm 109. As a result, both the open and the other hydraulic cylinders 181 and 182 are simultaneously operated so that the telescopic stretchable arm 115 is extended. When the piston 207 slides upward in the other hydraulic cylinder 182, the oil under pressure remaining in the discharge chamber of the other hydraulic cylinder 182 enters the inside of the other cylinder rod 184 by way of the through hole 211 and flows between the other cylinder rod 184 and the middle pipe 205 and thereafter returns to the oil pressure tank 163 by way of the port 215 and the connecting hose 138. The same operations are carried out in the one hydraulic cylinder 181. That is, the oil under pressure remaining in the discharge chamber of the one hydraulic cylinder 181 flows in through the port 201, the synchronous pipe 192 and the port 212 and flows out from the port 211.

According to the third embodiment, the pressure hose 133, the return hose 134, the pressure pipes 135 and 136 for supplying and discharging the oil under pressure are not complexly disposed in the stretchable arm 115 but can be centralized at the upper portion of the base arm 106. Accordingly, the structure of the excavator is simplified. Furthermore, since the pressure hoses which are liable to be deformed in the long use thereof are not necessary to be disposed complexly, and the maintenance of the deep excavator becomes easy.

According to the first to third aspects of the present invention, a stretchable arm of the deep excavator comprises the top, middle and base arms wherein the bucket is suspended from the top arm and a working unit fixed to the middle arm. In the working unit, the two hydraulic cylinders are arranged in parallel with each other while the cylinder rods thereof are directed in opposite directions wherein one cylinder rod of one hydraulic cylinder is coupled to the top arm and the other cylinder rod of the other hydraulic cylinder is coupled to the base arm. Discharge chambers and the pressure chambers of the two hydraulic cylinders are respectively coupled to each other wherein if the oil under pressure is supplied to the pressure chamber of one hydraulic cylinder, the oil under pressure discharged from the discharge chamber of one hydraulic cylinder is supplied to the pressure chamber of the other hydraulic cylinder. As a result, when the oil under pressure is supplied to one hydraulic cylinder, the other hydraulic cylinder is driven by one hydraulic cylinder. Accordingly, when the oil under pressure is supplied to one hydraulic cylinder, the other hydraulic cylinder is extended and contracted synchronously with one hydraulic cylinder whereby the extending and contracting speeds are remarkably increased. Accordingly, when the earth is excavated deeply to form the hole having a deep depth, it is possible to extend and contract each arm of the stretchable arm synchronously with one another at a higher speed compared with a conventional deep excavator having a single hydraulic cylinder. Since the pressure hose is coupled between one hydraulic cylinder and the other hydraulic cylinder, it is not necessary to provide pressure hoses at each hydraulic cylinder as in the conventional deep excavator, which can reduce the number of pressure hoses and make simple the structure thereof.

Accordingly to the second and third aspects of the present invention, the oil under pressure flowed out from the discharge chamber of each hydraulic cylinder is merged into the oil under pressure for extending each hydraulic cylinder and the so merged oil under pressure can be supplied to the pressure chamber so that the amount of oil under pressure to be supplied to the pressure chamber is increased compared with the oil under pressure merely supplied from the oil pressure source to the pressure chamber. Accordingly, it is possible to quicken the extension of each hydraulic cylinder and also quicken the excavation of the earth by the bucket so that the bucket can reach the bottom of the hole fast. Accordingly, the working efficiency can be improved.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A deep excavator comprising a chassis, a turntable disposed on the chassis, a boom which is pivotally supported on the turntable and is vertically swingable, a telescoping arm which is mounted on the boom and is telescoping in the longitudinal direction and comprises a plurality of telescopically assembled base, middle and top arms, and a bucket which is attached to the top arm for excavating and holding earth or sand, the deep excavator further comprising:

a working unit which is fixed to the middle arm and is operable by hydraulic power to telescopically extend or contract the telescoping arm, said working unit comprising a pair of hydraulic cylinders which are arranged physically in parallel with each other with cylinder rods thereof disposed to extend in opposite directions, wherein the cylinder rod of one hydraulic cylinder is connected to the base arm and the cylinder rod of the other hydraulic cylinder is connected to the top arm and fluid connecting passages joining pressure and discharge chambers of said one cylinder to respective pressure and discharge chambers of said other cylinder to cause synchronous extension and retraction of said cylinder rods of said pair of cylinders.

2. A deep excavator according to claim 1, wherein the discharge chambers are defined on the piston rod side of the respective cylinder.

3. A deep excavator according to claim 2, wherein one hydraulic cylinder of the working unit has a diameter which is larger than that of the other hydraulic cylinder and the cylinder rod of the one hydraulic cylinder has a diameter which is larger than that of the cylinder rod of the other hydraulic cylinder.

4. A deep excavator according to claim 2, wherein the discharge chamber of one hydraulic cylinder directly communicates with the pressure chamber of the other hydraulic cylinder.

5. A deep excavator according to claim 2, wherein a pressure application cross-sectional area of the discharge chamber of one hydraulic cylinder is equal to a pressure application cross-sectional area of the pressure chamber of the other hydraulic cylinder.

6. A deep excavator according to claim 2, wherein the one hydraulic cylinder having the cylinder rod coupled to the base arm has an oil introduction hole which communicates with the pressure chamber thereof and wherein the last-mentioned cylinder rod has an upper end opening to which a pressure hose is connected.

7. A deep excavator according to claim 2, wherein the one cylinder rod coupled to the base arm has an upper end opening which is connected to an oil pressure source and the discharge chamber of the other hydraulic cylinder is connected to an oil reservoir.

8. A deep excavator according to claim 2, further comprising first and second pilot check valves which are respectively connected between said one and the other hydraulic cylinders and an oil pressure source and are disposed in parallel with each other, each said pilot check valve being connected so as to receive oil pressure from a pressurized side of the other pilot check valve.

9. A deep excavator according to claim 2, wherein said pressure chambers of said hydraulic cylinders are directly connected to one another and said discharge chambers of said hydraulic cylinders are directly connected to one another, and a merging means for allowing the oil under pressure to flow in one direction between said pressure chambers and discharge chambers of said hydraulic cylinders.

10. A deep excavator according to claim 9, wherein the merging means comprises first and second check valves which are connected to each other in series so that flow control directions thereof are opposite to each other.

11. A deep excavator according to claim 2, wherein said pressure chambers of said hydraulic cylinders are directly connected to one another and said discharge chambers of said hydraulic cylinders are directly connected to one another, a pair of check valves disposed between the pressure chambers and the discharge chambers of said hydraulic cylinders, said check valves being connected to each other in series so that flow control directions thereof are opposite to each other, and a third check valve disposed between one of the pressure and discharge chambers of one of said hydraulic cylinders and an oil pressure source.

12. A deep excavator according to claim 11, wherein one of the pair of check valves disposed between the pressure chambers and the discharge chambers of said hydraulic cylinders is a pilot check valve which receives a pilot pressure from a pressure line which connects to the other check valve of said pair

13. A deep excavator according to claim 11, wherein said third check valve is disposed between the pressure chamber of said one hydraulic cylinder and said oil pressure source, and a fourth check valve is disposed between the discharge chamber of said one hydraulic cylinder and the oil pressure source.

14. A deep excavator according to claim 13, wherein the third check valve is disposed a first pressure line which connects to one of the pair of check valves and is a pilot check valve to which a pilot pressure is supplied from a second pressure line which connects to the other check valve of said pair, and wherein said other of the pair of check valves, is a pilot check valve to which a pilot pressure is supplied from said first pressure line.

15. A deep excavator according to claim 9, wherein the cylinder rod of the one hydraulic cylinder coupled to the base arm has a middle pipe of diameter which is smaller than that of the cylinder rod and said middle pipe is inserted into the cylinder rod in the longitudinal direction thereof, wherein a tip end of the middle pipe communicates with the pressure chamber of the other hydraulic cylinder and a space between the cylinder rod and the middle pipe communicates with the discharge chamber of the other hydraulic cylinder so that entrance and discharge of the oil under pressure are carried out at upper portion of the cylinder rod of the other hydraulic cylinder.

16. A deep excavator according to claim 11, wherein the cylinder rod of the one hydraulic cylinder coupled to the base arm has a middle pipe of diameter which is smaller than that of the cylinder rod and said middle pipe is inserted into the cylinder rod in the longitudinal direction thereof, wherein a tip end of the middle pipe communicates with the pressure chamber of the other hydraulic cylinder and a space between the cylinder rod and the middle pipe communicates with the discharge chamber of the other hydraulic cylinder so that entrance and discharge of the oil under pressure are carried out at an upper portion of the cylinder rod of the other hydraulic cylinder.

* * * * *

UNITED STATES PATENT AND TRADEMARK OFFICE

CERTIFICATE OF CORRECTION

PATENT NO. : 5 375 348

DATED : December 27, 1994

INVENTOR(S) : Mitsuhiro KISHI

It is certified that error appears in the above-indentified patent and that said Letters Patent is hereby corrected as shown below:

Column 19, line 31; after "arm" insert ---,---.

Column 20, line 12; delete "the".

line 37; after "pair" insert ---.---.

line 45; after "disposed" insert ---in---.

line 50; delete ",".

line 63; after "at" insert ---an---.

Signed and Sealed this

Eighteenth Day of April, 1995

Bruce Lehman

*Attest:*

BRUCE LEHMAN

*Commissioner of Patents and Trademarks*

*Attesting Officer*